US006158878A

United States Patent [19]

Lawrence

[11] Patent Number: 6,158,878

[45] Date of Patent: Dec. 12, 2000

[54] CONNECTOR SPACERS FOR DECORATIVE LIGHT STRINGS

[76] Inventor: Lonnie L. Lawrence, 2501 E. Eighth St., Odessa, Tex. 79761

[21] Appl. No.: 09/239,627

[22] Filed: Jan. 29, 1999

[51] Int. Cl.[7] ..... F21V 1/00

[52] U.S. Cl. ..... 362/238; 362/249; 362/250; 362/252; 362/123; 362/391; 248/48.1

[58] Field of Search ..... 362/123, 249, 362/250, 252, 391, 238; 248/48.1

[56] References Cited

U.S. PATENT DOCUMENTS

| | | | |
|---|---|---|---|
| 4,066,562 | 1/1978 | Wollensak et al. | 252/52 |
| 4,769,749 | 9/1988 | Felski | 362/250 |
| 4,890,206 | 12/1989 | Lee | 362/227 |
| 5,601,361 | 2/1997 | Lawrence | 362/238 |

*Primary Examiner*—Sandra O'Shea
*Assistant Examiner*—Ali Alavi
*Attorney, Agent, or Firm*—Locke Liddell & Sapp LLP; Monty L. Ross

[57] ABSTRACT

Unitarily molded plastic or rubbery connector spacers for use in arranging and flexibly interconnecting sections of decorative light strings into light display patterns, each connector spacer having at least two end members joined by a spacer strand of predetermined length, with each end connector being releasably attachable to the socket portion of a bulb and socket assembly or to the electrical conductors attached to the bulb and socket assembly, thereby limiting the maximum separation between interconnected sections of one or more decorative light strings.

37 Claims, 4 Drawing Sheets

CONNECTOR SPACERS FOR DECORATIVE LIGHT STRINGS

BACKGROUND OF THE INVENTION

1. Field of the Invention

This invention relates to a device useful for installing strings of decorative lights, and more particularly, to molded plastic connector spacers useful for releasably connecting decorative light strings having a plurality of decorative bulb and socket assemblies into an array forming a display pattern having a desired size and shape.

2. Description of Related Art

Many different devices have previously been disclosed for use in hanging, routing, joining, controlling and organizing decorative light strings. Such devices are disclosed, for example, in U.S. Pat. Nos. 5,096,945; 5,215,409; 5,215,519; and 5,558,585.

Nets have recently become particularly popular as a means for installing decorative lighting for interior or exterior holiday lighting displays. U.S. Pat. No. 5,601,361, discloses a rectangular array of interconnected strands to which conventional decorative light strings are attached. The strands can be solid, tubular, woven or braided and are typically made of a polymeric or textile material. Combinations of different materials can also be used depending, for example, on whether a particular strand is directly attached to a decorative light string or is simply used to provide support and spacing between adjacent light support strands.

One benefit of such light nets is that they maintain more regular spacing between the lights when light strings are installed on trees, shrubbery, or other support surfaces. Although decorative light strings are usually manufactured with the bulb and socket assemblies spaced equal distances apart, it can be difficult to maintain substantially the same spacing between adjacent rows of lights whenever a long string is wrapped around an object or looped back and forth over a surface, or when multiple decorative light strings are laid out in substantially parallel relation. Another benefit achieved through the use of light nets is reduced tangling of decorative light strings during installation or removal for storage. Once the light strings are attached to the nets, the nets can be deployed and subsequently recovered for storage and reuse with minimal time and effort required.

Disadvantages have also been encountered in using the conventional, commercially available light nets. Because of their inherent geometry, conventional light nets are primarily useful for displaying lights in a substantially rectangular array, no matter whether the net is hung against a wall, draped over shrubbery, or wrapped around a tree trunk or other object. Although the nets can be folded or shaped as they are deployed, such shaping reduces the light spacing in some areas, making the resulting lighting effect more irregular than would otherwise be desirable. Also, because the conventional light nets are usually manufactured in certain predetermined rectangular sizes corresponding to the number of lights (e.g., 50 or 100) in an ordinary decorative light string, the size of the rectangular array may be either larger or smaller than would otherwise be preferred.

SUMMARY OF THE INVENTION

The connector spacers disclosed herein are useful for arranging and installing decorative light strings, sometimes referred to as light sets, in lighting displays of many different patterns. The connector spacers of the invention are novel and readily distinguishable from conventional light nets, but are similarly effective in maintaining desired alignment and spacing when one or more decorative light strings are deployed as, for example, in a holiday lighting display. Furthermore, the connector spacers disclosed herein permit the user to create designs and patterns with decorative light strings that are not achievable using the commercially available light nets. Some connector spacers of the invention can be used to connect decorative light strings made using "mini" lights; other connector spacers of the invention can be used with decorative light strings made using C-7 or C-9 sized bulbs. The connector spacers of the invention both fasten and tether the decorative bulbs or lamps at desired distances apart, as determined by the length of the spacer strands, and can attach to the sockets or to the electrical conductors extending from the sockets. Light display patterns having the desired shapes are thereby formed.

According to one preferred embodiment of the invention, each connector spacer is molded from a suitable plastic material, most preferably high density polyethylene, and comprises a flexible strand connecting at least one end fitting disposed at each end of the strand. The overall length of the spacer connector preferably approximates the spacing between adjacent bulb and socket assemblies in a conventional decorative light string. In one particularly preferred embodiment, each end fitting is adapted to be releasably connected to the socket portion of a mini light bulb and socket assembly in a decorative light string. In another particularly preferred embodiment of the invention, two end fittings are connected to each end of the flexible strand and one such fitting is desirably releasably attached to the light string conductors on each side of a C-7 or C-9 bulb and socket assembly to form a yoke around the bulb and socket assembly. The yoke thus formed restricts the connector spacer from sliding along the conductors between adjacent bulb and socket assemblies. In still another particularly preferred embodiment, a single end fitting of a spacer connector is releasably connected adjacent to a single bulb and socket assembly by gathering all the electrical conductors attached to a socket and inserting them through the gate or aperture of the end fitting.

Although high density polyethylene is a preferred resin for use in making the connector spacers of the invention, similarly effective, flexible materials including other olefinic polymers, copolymers or terpolymers, polyamides, rubbery polymers, flexible composite materials, and the like, can also be used in making the subject connector spacers if desired. Injection molding is a preferred method for making the subject connector spacers, but they can also be made unitarily from a polymeric resin by thermoforming, stamping from a web, or other similarly effective means. Alternatively, connector spacers can also be made by attaching at least one connector fitting to each end of a flexible segment of wire, textile or polymeric material. End fittings can be attached using mechanical connectors, chemical bonding, thermal welding or other similarly effective means.

A plurality of the subject connector spacers can be provided to consumers in packages containing quantities that correspond to some fraction or multiple of the number of bulb and socket assemblies in conventional decorative light strings. Although it is believed that connector spacers of a single length will be satisfactory for many purposes, assortments containing connectors of two or more lengths can also be provided within the scope of the invention.

Through use of the connector spacers for decorative light strings disclosed herein, consumers can fashion conventional linear, decorative light strings into a plurality of different patterns having various shapes and sizes. Use of the connector spacers disclosed herein make it possible, for example, to create lighting display patterns having the shape of rectangles, triangles or spirals while maintaining light separation and spacing consistent with an aesthetically pleasing display. If desired, a plurality of relatively small lighting arrays can be fashioned from a long, single decorative light string by using the connector spacers of the invention to create the desired shape for each array and using the decorative light string to provide continuity to the next array. The thickness of the end fittings of the subject connector spacers is desirably such that one end fitting from each of two different connector spacers can be installed around a single decorative light socket, thereby permitting a single bulb and socket assembly to be linked in two different directions to two other bulb and socket assemblies.

Although an array of decorative lights created using the connector spacers of the invention can be recovered and stored without disassembly in much the same way as a conventional light net, the individual connector spacers can also be conveniently removed if desired to permit subsequent use of the decorative light string without connector spacers or reattachment of the connector spacers to produce a differently sized or shaped array or display pattern.

According to another embodiment of the invention, the individual connector spacers can be made with end fittings that are selectively useful either for attachment to a decorative bulb and socket assembly or, if desired, to each other in end-to-end relation to produce a link or connection having greater length than is otherwise attainable using a single connector spacer of a given length. In some instances, the subject connector spacers can also be used to provide a connective link between a decorative light socket and the electrical cord portion of a decorative light string or between two electrical cord segments of the same or different decorative light strings.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
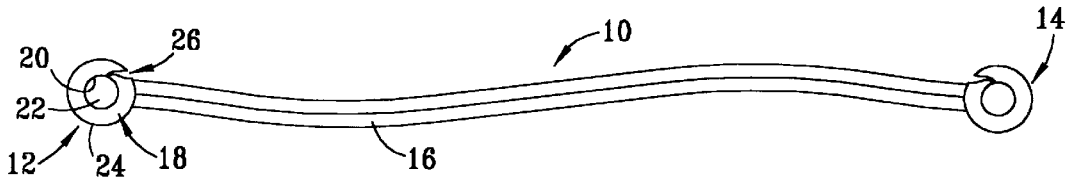
FIG. 1 is a plan view of a preferred connector spacer of the invention, not connected to any decorative light string.
Figure 2:
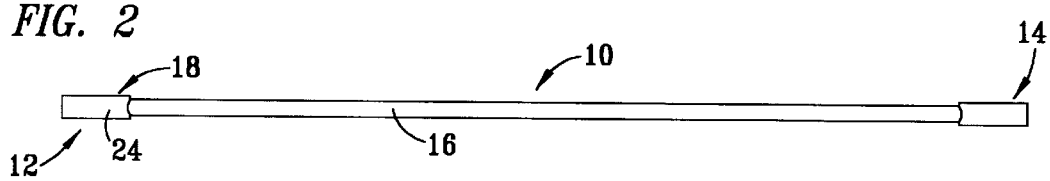
FIG. 2 is a front elevation view of the connector of FIG. 1.
Figure 3:
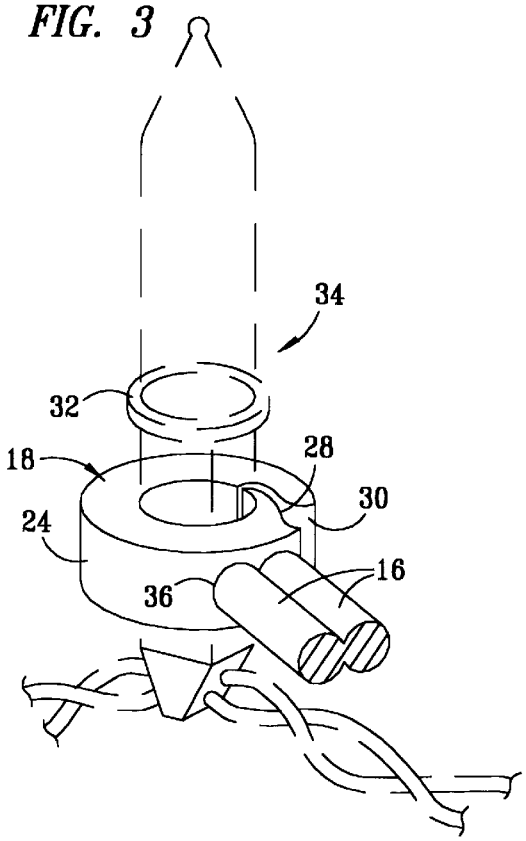
FIG. 3 is an enlarged, top front perspective view of one end of the connector spacer of FIGS. 1 and 2, showing the connector end installed around a mini light bulb and socket assembly of a decorative light string, which is shown in dashed outline, and showing a cross-sectional view through the strand portion of the connector spacer.

Referring to FIGS. 1–3, connector spacer 10 of the invention preferably comprises opposed end members 12, 14 that are attached and interconnected by spacer strand 16. Connector spacer 10 is preferably unitarily molded from a polymeric material, most preferably from polyethylene, polypropylene, or copolymers or terpolymers made from monomers of those resins in combination with other materials. It should be understood, however, that other polymers including, for example, polyamides, rubbery polymers, and the like, can also be used for making connector spacers 10 of the invention. While the manufacture of connector spacers 10 by conventional injection molding equipment is preferred, thereby necessitating the use of injection moldable resins, it will be appreciated upon reading this disclosure that connector spacers 10 can also be thermoformed or stamped from a web of plastic or rubbery material within the scope of the invention.

As shown in FIGS. 1–3, end members 12, 14 of connector spacer 10 preferably comprise a substantially cylindrical collar 18 with an inside wall 20 defining a void 22, an outside wall 24, and a tension gate fastener structure further comprising an aperture 26 having opposed walls 28, 30 traversing collar 18 from inside wall 20 to outside wall 24. According to one particularly preferred embodiment of the invention, aperture 26 is nonlinear and has a variable width that is greatest adjacent to outside wall 24. The diameter of void 22 defined by inside wall 20 is desirably slightly smaller than the diameter of socket portion 32 of a decorative bulb and socket assembly 34, and aperture 26 is desirably provided to facilitate the insertion of socket 32 through collar 18 into void 22. Thus, collar 18 is expandable at aperture 26 so that collar 18 can be fitted around socket 32, after which inside wall 20 of collar 18 desirably frictionally engages socket 32 tightly enough that bulb and socket assembly 34 is not accidentally pulled out of collar 18 in an axial direction or through aperture 26 in a substantially radial direction during normal use. The width and thickness of collar 18 are desirably sufficient to hold socket 32 against a reasonable tugging force as might be experienced during installation or recovery of a lighting display made using the connectors, but flexible enough to permit the connector to be attached to and released from decorative light strings as needed. The diameter, flexibility and elasticity of collar 18 may be such that "one size fits all" or connector spacers 10 can be made with collars 18 of different diameters, depending upon the intended use. Collar 18 is also preferably thin enough that two collars can be attached to a single socket 32, stacked one above the other, as discussed below in relation to FIG. 6, where common attachment to a single socket is desired in assembling a display pattern using a plurality of connector spacers 10.

Spacer strand 16 as depicted in FIGS. 1–3 is molded with a width and cross-section similar to that of a conventional electrical power cord, although it will be appreciated that other cross-sections are likewise useful for making connector spacer 10 of the invention. The ratio between the length and cross-sectional area of strand 16 and the material from which it is made are preferably such that the resultant strand 16 is flexible. Strand 16 can be made in any desired length, and a strand length approximately equal to the spacing between bulb and socket assemblies 34 in a conventional decorative light string is generally preferred, although shorter or longer strand lengths may be desirable for use in creating some lighting display patterns.

Strand 16 preferably extends substantially perpendicularly from outside wall 24 of collar 18 at a location closely adjacent to the outwardly facing gap between opposed walls 28, 30 of aperture 26. Locating the point of attachment 30 of strand 16 to collar 18 near aperture 26 assists the user in inserting socket 32 between opposing walls 28, 30 of collar 18 and minimizes the chance of unintended release during installation and use. By grasping strand 16 near collar 18 with one hand, the user can grasp the decorative light bulb and socket assembly 34 with the other hand, position socket 32 against outside wall 24 of collar 18 over aperture 26, and force opposed walls 28, 30 farther apart to permit socket 32 to be inserted between walls 28, 30 into void 22, where it is then held in place by frictional engagement with inside wall 20. Connector spacers 10 can be packaged in single sizes or grouped in assortments comprising a plurality of connector spacers 10 having various collar diameters or strand lengths.

While connector spacers 10 are described herein in relation to a preferred embodiment having connector end members or connector end fittings 12, 14 in the form of split collars 18 attached to strands 16, it is understood that end members 12, 14 having differently configured but similarly effective structures can also be used within the scope of the present invention.

Figure 4:
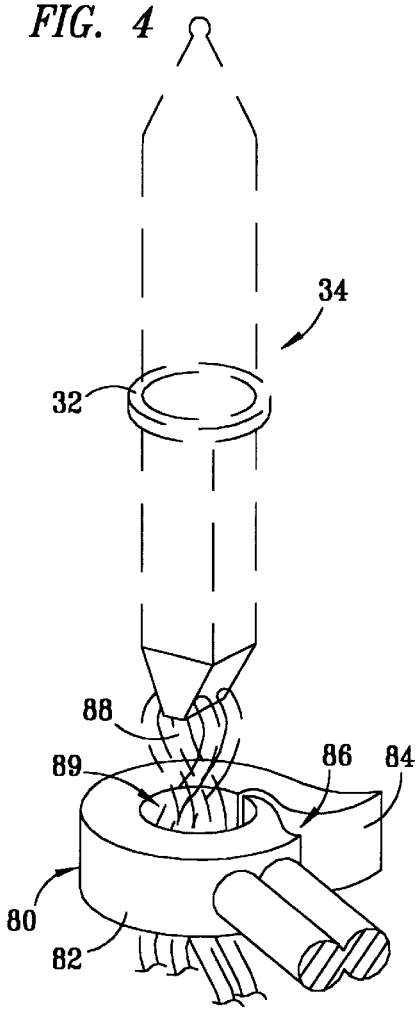
FIG. 4 is an enlarged, top front perspective view of one end of the connector spacer of FIGS. 1 and 2, showing the connector end installed around electrical conductors under a mini light bulb and socket assembly of a decorative light string, which is shown in dashed outline, and showing a cross-sectional view through the strand portion of the connector spacer.

Referring to FIG. 4, connector end member 80 has a collar 82 that is similar to collar 18 of FIG. 3, but with wall 84 of aperture 86 elongated to facilitate insertion of electrical conductors 88 through aperture 86 and into interior void 89. In this configuration, a single connector end member 80 is used to releasably secure all the electrical conductors 88 attached to socket 32 of bulb and socket assembly 34 without fitting directly around socket 32 as shown in FIG. 3. With this method of attachment, connector end member 80 can be used to secure a bulb and socket assembly of any size, whether mini light, C-7 or C-9.

Figure 5:
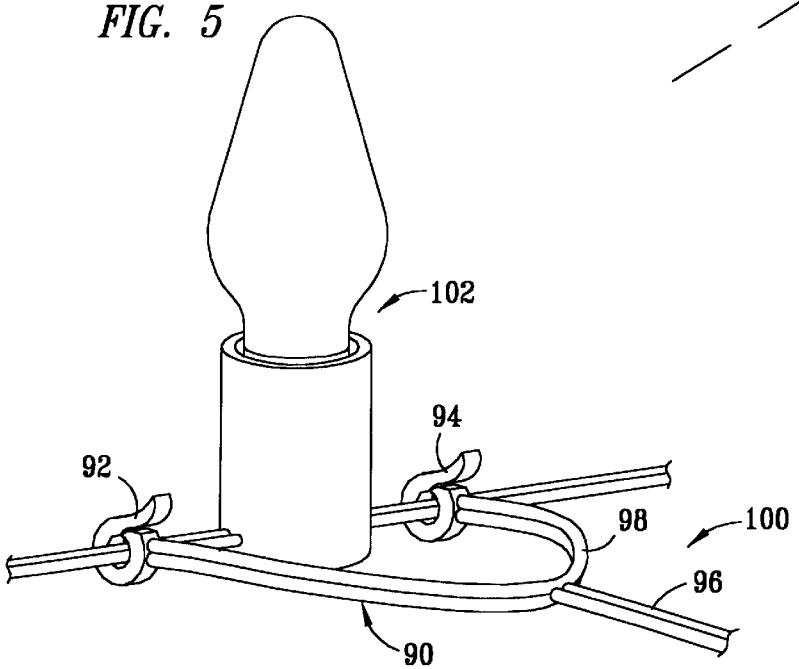
FIG. 5 is an enlarged, front perspective view of one end of another embodiment of the connector spacer of the invention, showing two connector end fittings attached by a yoke member to one end of a single spacer strand, each end fitting being releasably connected to the electrical conductor of a C-7 or C-9 bulb and socket assembly of a decorative light string, the connector end fittings and yoke member restricting movement of the connector spacer relative to the bulb and socket assembly.

Referring to FIG. 5, connector end member 90 differs from those in the previous figures in that it comprises two separate connector fittings 92, 94 similar in configuration to member 80 described in relation to FIG. 4. Connector fittings 92, 94 are attached to spacer strand 96 by yoke member 98 that cooperates with the connector fitting to restrict the range of movement of connector spacer 100 away from bulb and socket assembly 102. With this embodiment of the invention, connector spacers 100 having connector members too small to fit around a C-7 or C-9 bulb and socket assembly can be used to construct a light display pattern. Yoke member 98 and spacer strand 96 can be made of the same or different materials if joined in fixed relation to each other by suitable means, although the entire connector spacer 100 is preferably unitarily molded from a polymeric material as previously described.

Figure 6:
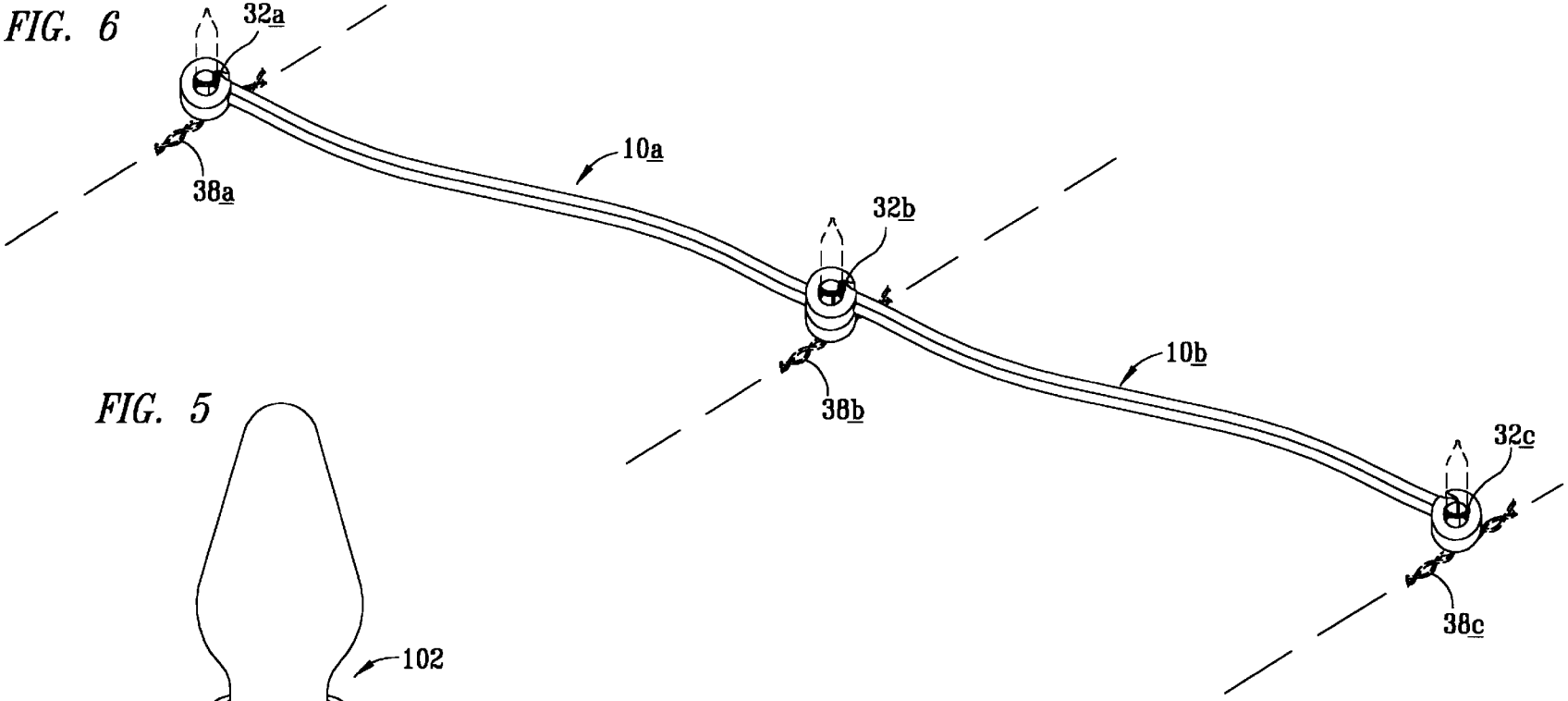
FIG. 6 is a simplified perspective view showing two connector spacers of the invention installed so as to connect three spaced-apart segments of decorative light strings, which are shown in dashed outline.
Figure 7:
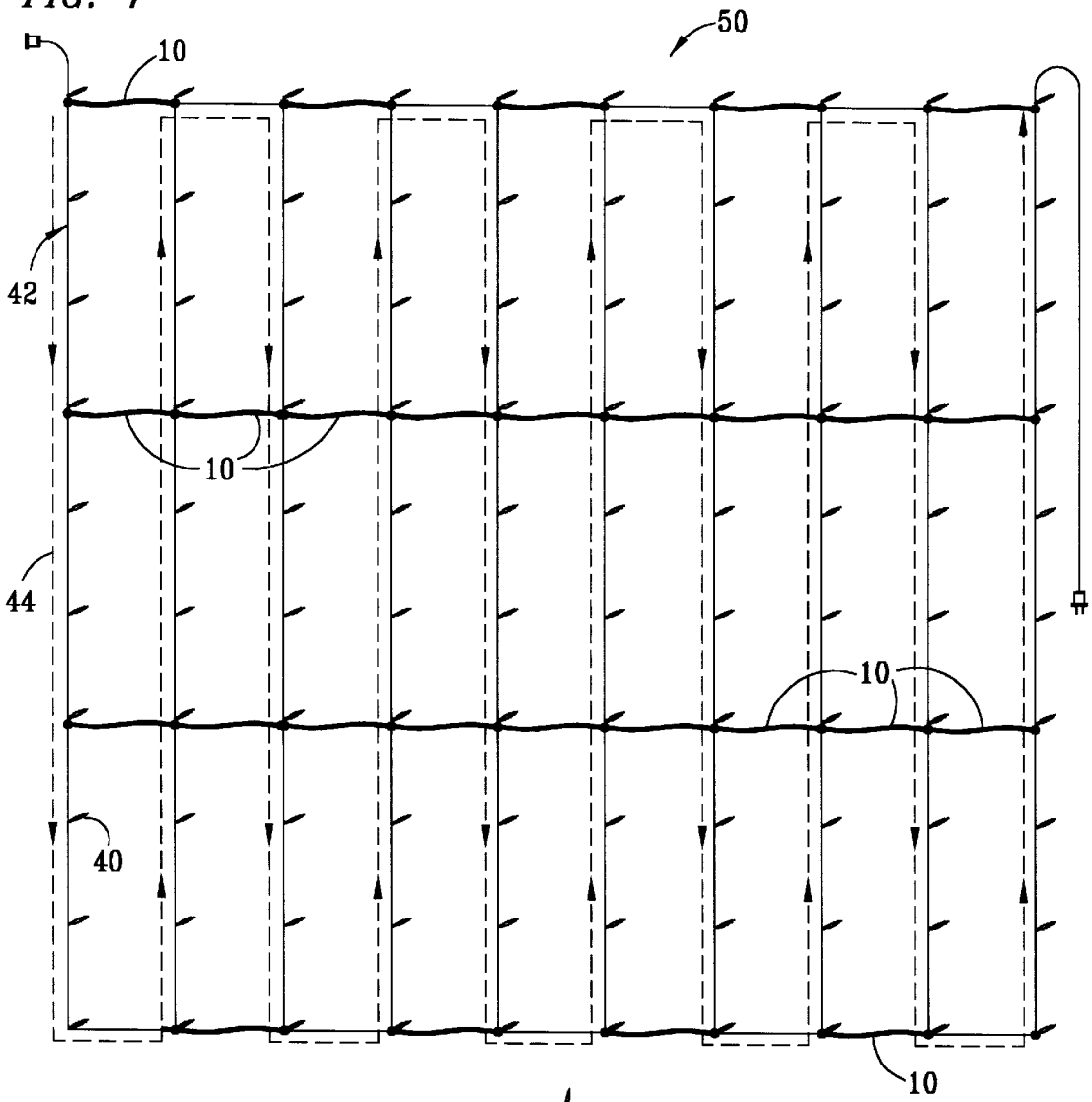
FIG. 7 is a simplified schematic showing how a plurality of the connector spacers of the invention are used to form a rectangular array of decorative lights from a single, conventional decorative light string having 100 bulb and socket assemblies.

Referring to FIG. 6, connector spacers 10*a*, 10*b* of the invention can be used, for example, to join socket members 32*a*, 32*b* and 32*c* of parallel light string sections 38*a*, 38*b*, and 38*c*, which sections may be from different light strings or portions of a single light string. When used in this manner, one end member of each of connector spacers 10*a*, 10*b* is attached to socket 32*b* of light string section 38*b*, the two end members being stacked one on the other. Using this method for attaching the subject connectors to light string sections, one can produce the light display pattern 50 depicted in FIG. 7. Referring to FIG. 7, a single decorative light string having 100 spaced-apart bulb and socket assemblies 40 connected by electrical conductors 42 (shown in simplified, diagrammatic form) is looped back and forth to form ten parallel light string sections of 10 lights each. In FIG. 6, a dashed line 44 with arrows is used to track the light string through the array. Along the upper and lower edges of the array, connector spacers 10 of the invention are used to connect the bulb and socket assemblies 40 that are not already directly connected to each other by the electrical conductor 42. Connector spacers 10 are also applied to interconnect bulb and socket assemblies 40 in every third row of bulbs inside the array. Although the light display pattern of FIG. 7 could be produced using fewer or more connector spacers 10, the use of 29 connector spacers 10 as shown is believed to be satisfactory for maintaining the shape and stability of this lighting array in most applications. It will be apparent from FIG. 7 that essentially the same array can be produced using two light strings of 50 lights each attached end-to-end if the excess cord length at either end of the light string is gathered to permit alignment of the 100 bulbs in the same positions.

Figure 8:
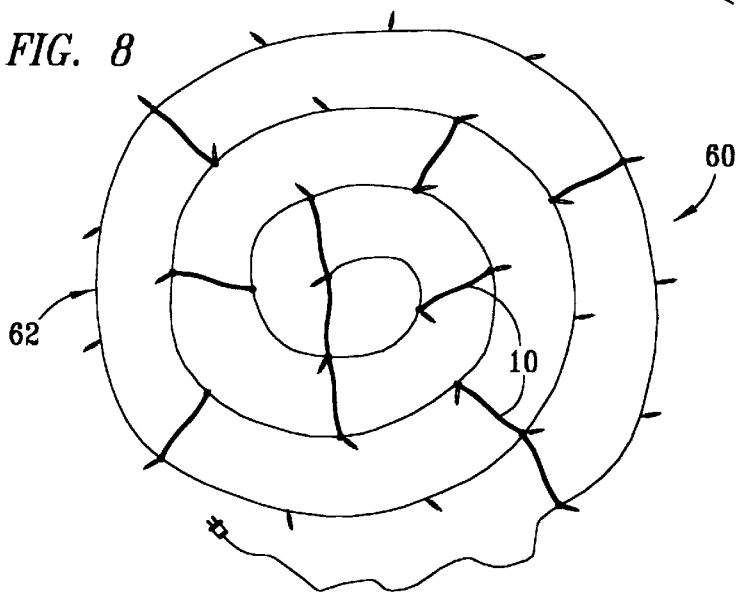
FIG. 8 is a simplified schematic showing how a plurality of the connector spacers of the invention are used to form a spiraling, continuous array from a single, conventional decorative light string.

Referring to FIG. 8, a spiral-shaped display pattern 60 is produced from a single decorative light string 62 by using a plurality of connector spacers 10 at irregular intervals to provide approximately equal spacing between adjacent curves.

Figure 9:
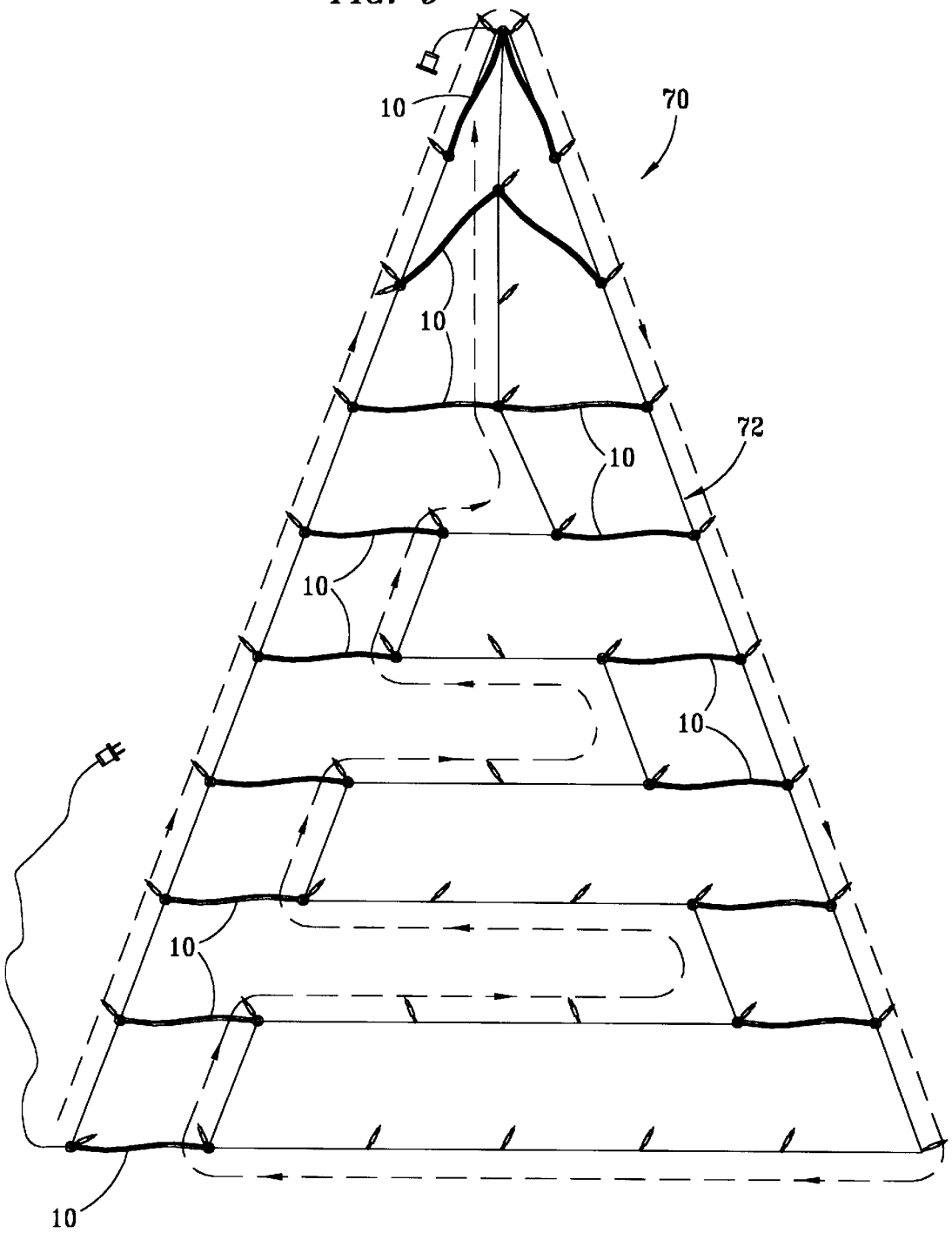
FIG. 9 is a simplified schematic showing how a plurality of the connector spacers of the invention are used to form a triangular, tree-shaped array from a single, conventional decorative light string.

Referring to FIG. 9, a triangular display pattern 70 intended to simulate a Christmas tree is made using connector spacers 10 in combination with a single decorative light string 72. In this view, as in FIG. 7, a dashed line with arrows is provided to trace the path of light string 72.

These and other light display patterns are most easily made by arranging one or more strings of decorative lights into the desired shape, the strings having electrical conductors that may or may not be linked to form even longer light strings, while working on a flat surface such as a floor or on the ground. Once the preferred shape has been established, perhaps using an underlying pattern if desired, the connector spacers of the invention are then attached to the light strings so as to maintain the general arrangement, spacing and shape of the pattern even when the assembly thus produced is rolled up or moved to another location for use. The short connector spacers are the building blocks that can transform single strands of electric light strings into many shapes and forms, which can become three dimensional when overlaid over other objects.

From these drawings it is now apparent that many different shapes and lighting display patterns can be made from one or more conventional decorative light strings using the connector spacers of the invention. It is also possible to use connector spacers of the invention to connect portions of the electrical conductor of a decorative light string to a socket or to another conductor section, or to connect an end of one connector spacer to the middle or end of another connector spacer to provide alternative spacing between decorative light string sections if desired. Where the attachment of connector end members to cords as opposed to sockets is contemplated, it may be desirable to make the narrowest portion of the collar aperture sufficiently narrow that the conductor, cord or other connector to which a collar is attached will not accidentally become disengaged.

As with conventional light nets, the lighting display patterns made using connector spacers of the invention can be rolled up for storage between uses. However, unlike with many conventional light nets, the display patterns made using connector spacers of the invention can also be disassembled for subsequent use in a different manner or configuration if desired. It is important to note that since each connector spacer is a separate element, it can work both cooperatively with and independently of the other spacers, pivoting at different angles to the others as necessary to provide support and limit spacing in producing a given pattern.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A connector spacer useful for providing a connective link between bulb and socket assemblies of a decorative light string having a plurality of adjacent bulb and socket assemblies electrically connected at regular intervals by flexible electrical conductors interconnecting adjacent bulb and socket assemblies, the connector spacer comprising:

at least two end connector members, each end connector member having a structure releasably attachable to a decorative light string; and at least one flexible spacer strand of predetermined length attached to and interconnecting the two end connector members for creating a connective link between non-adjacent spaced-apart sections of a decorative light string and limiting the maximum separation between the non-adjacent spaced-apart sections of a decorative light string whenever each end member is releasably attached to a decorative light string to thereby link bulb and socket assemblies independent of the electrical connections made by the flexible electrical conductors.

2. The connector spacer of claim 1 wherein at least one end connector member comprises a split collar sized to frictionally engage a socket of a bulb and socket assembly of a decorative light string.

3. The connector spacer of claim 2 wherein the split collar is expandable, has an outside wall, and surrounds a void sized to receive the socket of a bulb and socket assembly of a decorative light string.

4. The connector spacer of claim 3 wherein the collar is split by an aperture defined by opposed walls extending outwardly from the void to the outside wall.

5. The connector spacer of claim 4 wherein the opposed walls have a gap of varying width therebetween.

6. The connector spacer of claim 5 wherein the width of the gap is greatest adjacent to the outside wall.

7. The connector spacer of claim 1 wherein the two end members and a strand member are unitarily molded.

8. The connector spacer of claim 7 wherein the two end members and a strand member are unitarily molded from a flexible polymer.

9. The connector spacer of claim 8 wherein the flexible polymer is selected from the group consisting of polyolefins and polyamides.

10. The connector spacer of claim 9 wherein the flexible polymer is selected from polyethylene, polypropylene, and copolymers and terpolymers thereof.

11. The connector spacer of claim 8 wherein the flexible polymer comprises a rubbery polymer.

12. The connector spacer of claim 10 wherein the flexible polymer is high density polyethylene.

13. The connector spacer of claim 4 wherein the spacer strand is connected to the outside wall of the collar near the aperture.

14. The connector spacer of claim 4 wherein the spacer strand is unitarily molded to the collar.

15. The connector spacer of claim 1 wherein at least one end connector member is releasably attachable to the electrical conductor portions of a decorative light string below a bulb and socket assembly.

16. The connector spacer of claim 1 wherein at least one end connector member is also releasably attachable to at least one end connector member of another connector spacer.

17. The connector spacer of claim 1 comprising two end connector members attached to each end of the spacer strand, each connector member being releasably attachable to the electrical conductors connecting the bulb and socket assemblies of the decorative light string.

18. The connector spacer of claim 1 wherein the two end connectors at each end of the spacer strand are attached to each other and to the spacer strand by a yoke member having sufficient length to permit each end connector to be releasably attached to the electrical conductors on opposite sides of a bulb and socket assembly.

19. A light display pattern comprising:

at least one decorative light string, each such decorative light string further comprising a plurality of adjacent bulb and socket assemblies electrically connected at regular intervals by flexible electrical conductors interconnecting the adjacent bulb and socket assemblies; and a plurality of connector spacers, each connector spacer providing a connective link between non-adjacent spaced-apart sections of a decorative light string, the connector spacers further comprising at least two end members, each end member being releasably attached to a decorative light string, and at least one flexible spacer strand of predetermined length attached to and interconnecting the two end members to limit the maximum separation between the non-adjacent spaced-apart sections of a decorative light string to thereby link bulb and socket assemblies independent of the electrical connections made by the flexible electrical conductors.

20. The light display pattern of claim 19 wherein at least one end member of a connector spacer comprises a split collar sized to frictionally engage a socket of a bulb and socket assembly of a decorative light string.

21. The light display pattern of claim 20 wherein the split collar is expandable, has an outside wall, and surrounds a void sized to receive the socket of a bulb and socket assembly of a decorative light string.

22. The light display pattern of claim 21 wherein the collar is split by an aperture defined by opposed walls extending outwardly from the void at least to the outside wall.

23. The light display pattern of claim 22 wherein the opposed walls have a gap of varying width therebetween.

24. The light display pattern of claim 23 wherein the width of the gap is greatest adjacent to the outside wall.

25. The light display pattern of claim 17 wherein the two end members and a strand member are unitarily molded.

26. The light display pattern of claim 25 wherein the two end members and a strand member are unitarily molded from a flexible polymer.

27. The light display pattern of claim 26 wherein the flexible polymer is selected from the group consisting of polyolefins and polyamides.

28. The light display pattern of claim 27 wherein the flexible polymer is selected from polyethylene, polypropylene, and copolymers and terpolymers thereof.

29. The light display pattern of claim 26 wherein the flexible polymer comprises a rubbery polymer.

30. The light display pattern of claim 27 wherein the flexible polymer is high density polyethylene.

31. The light display pattern of claim 18 wherein the strand is connected to the outside wall of the collar near the aperture.

32. The light display pattern of claim 20 wherein the spacer strand is unitarily molded to the collar.

33. The light display pattern of claim 19 wherein at least one end member is releasably attached to the electrical conductors of a decorative light string.

34. The light display pattern of claim 19 wherein at least one end member is also releasably attached to at least one end member of another connector spacer.

35. The light display pattern of claim 19, having a rectangular shape.

36. The light display pattern of claim 19, having a triangular shape.

37. The light display pattern of claim 19, having a spiral shape.

* * * * *